United States Patent [19]

Sasabe et al.

[11] Patent Number: 5,011,798

[45] Date of Patent: Apr. 30, 1991

[54] CHROMIUM ADDITIVE AND METHOD FOR PRODUCING CHROMIUM ALLOY USING THE SAME

[75] Inventors: Minoru Sasabe, Chiba; Masao Imamura, Yamagata; Yasunobu Yoshida, Yamagata; Shinya Andoh, Yamagata; Hiroshi Miyake, Yamagata, all of Japan

[73] Assignee: Tosoh Corporation, Shinnanyo, Japan

[21] Appl. No.: 413,601

[22] Filed: Sep. 28, 1989

[51] Int. Cl.[5] ..... C22C 1/02; C22C 1/03

[52] U.S. Cl. ..... 501/87; 75/233; 75/303; 75/313; 148/423; 419/14; 419/19; 420/71; 420/116; 420/129; 420/428; 420/588; 420/590; 423/417

[58] Field of Search ..... 420/428, 588, 590, 71, 420/116, 129; 148/423; 419/11, 14, 17, 19; 75/233, 303, 313; 423/417; 501/87

[56] References Cited

U.S. PATENT DOCUMENTS 3,847,601 11/1974 Itoh et al. ..... 420/116
4,565,574 1/1986 Katayama et al. ..... 420/71

OTHER PUBLICATIONS

CA 112(10): 90402r 1989.

*Primary Examiner*—R. Dean
*Assistant Examiner*—Margery S. Phipps
*Attorney, Agent, or Firm*—Oblon, Spivak, McClelland, Maier & Neustadt

[57] ABSTRACT

A chromium additive of the formula: $Cr_xC_yO_z$ where $0.04 \leqq y \leqq 0.35$, and $0.03 \leqq z \leqq 0.30$ for $x=1$, said additive having an X ray diffraction peak at $d=3.32$ Å ($2\theta=26.8°$).

8 Claims, 5 Drawing Sheets

CHROMIUM ADDITIVE AND METHOD FOR PRODUCING CHROMIUM ALLOY USING THE SAME

BACKGROUND OF THE INVENTION

1. Field of the Invention:

The present invention relates to a chromium additive for producing chromium alloys, and to a method for producing chromium alloys by use of the chromium additive.

2. Description of the Background:

Chromium has been used as an additive in various metallic materials, since chromium, as an alloying element, remarkably improves the heat resistance, corrosion resistance, and abrasion resistance of the alloy.

In recent years, in order to meet the increasing requirement for metals of higher performance characteristics, the quantity of chromium added to such metals has tended to increase.

In the past, ferrochrome has been almost exclusively used as a chromium additive (hereinafter referred to as an "additive") in the production of various chromium alloys, while metallic chromium prepared through the thermit process has been used as an additive for alloys such as chromium-aluminum alloys which do not require iron as an alloy constituent. However, ferrochrome contains iron in amounts as high as about 60% by weight, and also contains much carbon resulting from the use of carbon as a reducing agent in its production. On the other hand, metallic chromium prepared by the thermit process, although it is satisfactory from the viewpoint of chromium content, varies significantly in its quality because it is normally produced by a batch reaction, and additionally contains significant amounts of aluminum resulting from the use of aluminum as a reducing agent in its production.

Generally, superalloys which contain chromium as a main constituent are used in the manufacture of the likes of turbine blades which are employed in jet engines, oil pipes for deep oil wells, etc. Such applications require the addition of large amounts of chromium to a metal.

The use of ferrochrome or thermit metallic chromium as an additive in superalloys, as mentioned above, causes an adverse effect on properties of the superalloys because of the accompanying large contamination of the superalloys with carbon or aluminum.

The use of electrolytic metallic chromium, which contains lesser amounts of impurities, may be thought of as reasonable as an additive in such superalloys. However, electrolytic chromium has several disadvantages which include the fact that its production requires many steps and that the electrolytic chromium does not easily dissolve in the molten metal during the production of the alloys. A need therefore continues to exist for an improved method of adding chromium to various metals.

SUMMARY OF THE INVENTION

Accordingly, one object of the present invention is to provide a process for producing chromium alloys, including superalloys, which contain reduced amounts of undesired components other than chromium.

Briefly, this object and other objects of the present invention as hereinafter will become more readily apparent can be attained in one aspect of the invention wherein a chromium additive is provided which has the formula: $Cr_xC_yO_z$, wherein $0.04 \leqq y \leqq 0.35$, and $0.03 \leqq z \leqq 0.30$ for $x=1$, the additive having an X ray diffraction peak at $d=3.32$ Å ($2\theta=26.8°$).

In another aspect of the present invention, a method for producing a chromium additive of the formula $Cr_xC_yO_z$, wherein $0.04 \leqq y \leqq 0.35$ and $0.03 \leqq z \leqq 0.30$ for $x=1$, the additive having an X ray diffraction peak at $d=3.32$ Å ($2\theta=26.8°$), is provided in which chromium oxide and carbon are mixed and pelletized and subsequently the mixture is heated and reduced.

In yet another aspect of the present invention, a method for producing a chromium alloy is provided which comprises the steps of adding an additive of the formula: $Cr_xC_yO_z$, where in $0.04 \leqq y \leqq 0.35$, and $0.03 \leqq z \leqq 0.30$ for $x=1$, which has an X ray diffraction peak at $d=3.32$ Å ($2\theta=26.8°$), to a molten metal; and then blowing an inert gas onto or into the melt.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The chromium additive of the present invention has the formula: $Cr_xC_yO_z$ wherein $0.04 \leqq y \leqq 0.35$, and $0.03 \leqq z \leqq 0.30$ for $x=1$, and has an X ray diffraction peak at $d=3.32$ Å ($2\theta \leqq =26.8°$).

This additive contains oxygen and carbon in well-balanced amounts, thereby eliminating contamination of the resultant chromium alloy with an ingredient other than chromium coming from the additive during its production, since in the high temperature refinement employed in the production process, the carbon in the additive is utilized as a heat source for maintaining the refining temperature and the excess carbon is removed rapidly together with the oxygen present in the additive in the form of carbon monoxide.

This additive consists substantially of chromium, carbon, and oxygen with unavoidable components, and results in less generation of slag and less loss of chromium in the slag, and leads to a high chromium efficiency. The use of the additive of the present invention provides substantial advantages in alloy design, since it enables the production of every kind of chromium alloy including superalloys, and it increases the utilization efficiency of the chromium.

Figure 1:
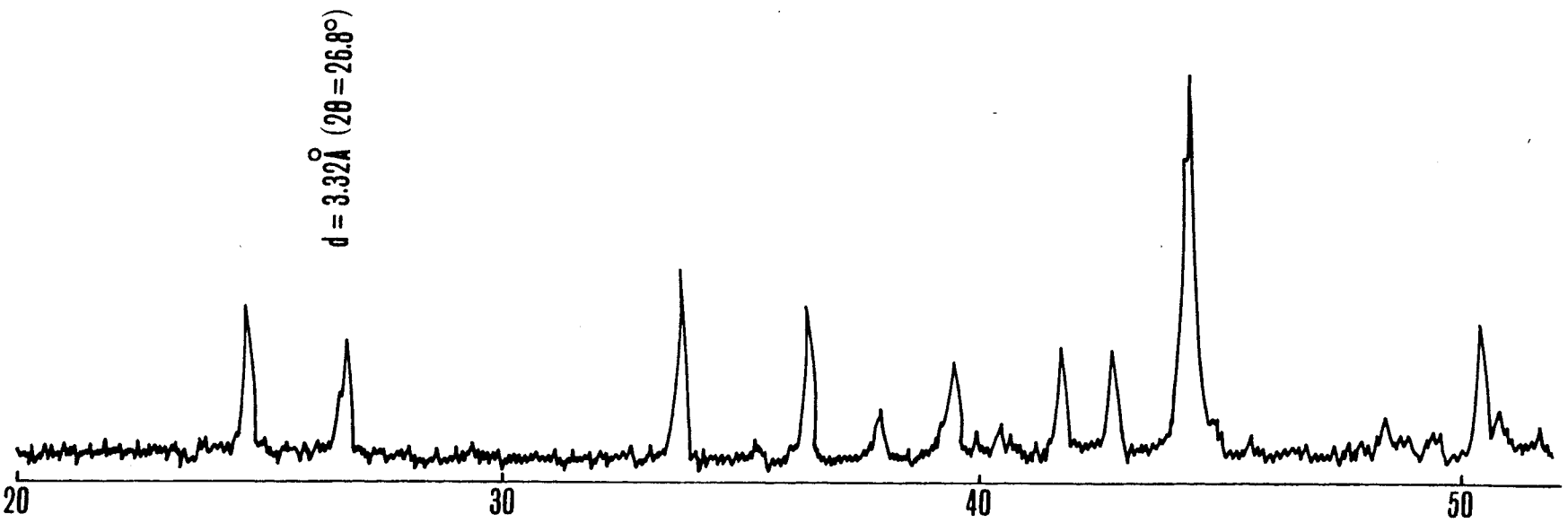
FIG. 1 shows an example of an X ray diffraction pattern of an embodiment of the chromium additive of the present invention.

The additive of the invention exhibits a peak of $d=3.32$ Å ($2\theta=26.8°$) as shown in FIG. 1, which shows that it is not a mixture of chromium oxide, chromium carbide, and metallic chromium.

In producing a chromium alloy by using a mixture of chromium oxide, chromium carbide and chromium metal as the additive, the metallic chromium in the mixture rapidly dissolves in the molten metal which forms the alloy, while the chromium oxide in the mixture floats up through the molten metal because of its low specific gravity and is incorporated in the slag. This reduces the yield of the chromium. Additionally, the carbon and the oxygen in the mixture exist separately from each other, which lessens the reaction between the carbon and the oxygen, causing much carbon and oxygen to remain in the resulting alloy.

On the other hand, since the additive of the present invention is not a mixture, separation of the chromium oxide having low specific gravity from the metallic chromium does not occur as in the case of a mixture during the production of the alloy, but all of it is incorporated in the alloy. Thus, the yield of alloy is improved, and the carbon and oxygen existing in close proximity are eliminated from the alloy by their mutual reaction.

The additive of the present invention can, for example, be prepared by mixing and pelletizing chromium oxide and carbon and subsequently heating and reducing the mixture. Suitable raw materials for carbon include carbon black, artificial graphite, and petroleum coke. The ratio of the carbon and the oxygen in the resulting additive can be controlled by adjusting the amount of the carbon relative to the chromium oxide to be added. The amount of carbon to be used is preferably from 20 to 25% by weight of the chromium oxide. The use of carbon in this range will give a satisfactory balance of oxygen and carbon in the resulting additive.

The mixing and the pelletizing of raw materials can, for example, be conducted by mixing powdery chromium oxide and carbon, adding binder thereto, mixing again, and then press molding the mixture. Disintegration of the resulting pellets during reduction as the material is heated can be prevented by drying the pellets before reduction at a temperature of about 100° to 200° C. by means of a drier, a heater or the like.

Subsequently, the pellets are heated and reduced. The reduction under heating should preferably be conducted in the absence of oxygen, since contact of the pellets with oxygen may result in an increase of the oxygen content in the resulting additive.

The reduction of the pellets as they are heated may be conducted, for example, in a vacuum furnace under vacuum, or in an atmospheric heat-treating furnace or a kiln furnace flushed with an inert gas such as helium and argon or having the inert gas flow therethrough. Among them, the kiln furnace is preferable from the viewpoint of simplicity of its operation and mass-production.

If the degree of the reduction with heat is insufficient, the resulting additive contains more carbon, which may cause larger amounts of oxygen and carbon to remain in the alloy produced by use of the additive. A heating temperature of above 1500° C. may cause loss of chromium by evaporation. A reduction time of more than 3 hours is not effective to change the contents of oxygen and carbon in the resulting additive, and further impedes mass-production. Accordingly, reduction as the material is heated should preferably be conducted under the conditions of a heating temperature of from about 1200° C. to 1500° C., and a time of reduction of from 1 hour to 3 hours depending on the progress of the reaction and the amount of the raw materials employed.

In preparing an alloy from the additive of the invention, the additive in the form of pellets may be directly thrown into a molten metal, or the pulverized additive is injected into the molten metal.

The temperature of the molten metal at the time of addition of the additive is generally preferably within the range of from 1300° C. to 1700° C. Below 1300° C., the additive may possibly not dissolve in the molten metal, while above 1700° C. the alloy component may evaporate diminishing the yield of product. In the above method of addition, the carbon present in the additive functions as a source of heat, thereby eliminating the need for addition of a supplemental heat source such as carbon to the molten metal.

As mentioned above, the addition of the additive to a molten metal produces a chromium alloy. Further, the blowing of an inert gas onto the surface or into a melt of molten metal containing the additive lowers the carbon monoxide partial pressure of the atmosphere during alloy production which promotes the formation of carbon monoxide from the carbon and oxygen of the additive, thereby enabling control of contamination of the alloy with carbon and oxygen coming from the additive. The blowing of an inert gas on or into the melt agitates the melt, enabling production of a chromium alloy uniform in constituent ratio with less of an uneven distribution of the chromium constituent. The inert gas employed here may be of any kind, as long as it does not react severely with the alloy and is capable of lowering the partial pressure of the atmospheric carbon monoxide. Argon or nitrogen is one of the most easily handled inert gases therefor.

Having generally described this invention, a further understanding can be obtained by reference to certain specific examples which are provided herein for purposes of illustration only and are not intended to be limiting unless otherwise specified.

EXAMPLE 1

A chromium additive for alloying was prepared as follows:

The chromium oxide and graphite having the quality shown in Table 1 was used as the starting material. A 240 g amount of graphite per 1000 g of chromium oxide was blended with chromium oxide for 30 minutes. Subsequently, 200 g of 10% by weight of polyvinyl alcohol was added per 1000 g of chromium oxide to the blend and the resultant material was blended for 20 minutes. The mixture was pelletized into pellets of about 3 mm in diameter and about 5 mm in length by means of a pelleter. The pellets were dried and dehydrated in a drier for 8 hours.

TABLE 1

| | (% by weight) | | | | | |
|---|---|---|---|---|---|---|
| | Cr | C | Fe | Al | Si | P |
| Chromium Oxide | 68.0 | — | 0.005 | 0.003 | 0.003 | 0.0002 |
| Graphite | — | 99.2 | 0.003 | — | 0.002 | — |

The resulting pellets were heated and reduced in a continuous kiln furnace having a refractory and electrodes made of carbon. The kiln had a closed structure and had an interior which could be flushed with and maintained under an inert gas atmosphere. Reduction while heating was conducted by flowing a small amount of inert gas through the furnace at an interior pressure of several tens of Torr which prevented the infiltration of oxygen into the interior. The heating temperature was 1400° C. The pellets were fed at a rate of 5 kg per hour into the furnace. The residence time of the pellets was controlled to one hour by adjusting the rotation speed and the inclination of the kiln.

As the result, the additive showing metallic color in its interior was produced continuously from the outlet of the furnace. Table 2 shows the result of the analysis of the product.

TABLE 2

| | (% by weight) | | | | | |
|---|---|---|---|---|---|---|
| | Cr | C | O | Fe | Al | Si |
| Chromium Additive | 90.6 | 4.2 | 5.1 | 0.005 | 0.003 | 0.003 |

EXAMPLES 2-7

Chromium additives were prepared in the same manner as described in Example 1, except that the mixing ratio of chromium oxide and graphite, and the kiln furnace inside temperatures were as shown in Table 3.

The results of the analysis of the resulting additives are shown in Table 3. The X ray diffraction patterns of the resulting chromium additives showed the peak at d=3.32 Å (2θ=26.8°).

TABLE 3

| | Reaction Conditions | | | Quantity of Additives (% by weight) | | |
|---|---|---|---|---|---|---|
| | Mixing Ratio | | Kiln Inside | | | |
| Example No. | Chromium Oxide | Graphite | Temperature (°C.) | Cr | C | O |
| 2 | 1,000 | 240 | 1,300 | 89.4 | 4.9 | 5.6 |
| 3 | 1,000 | 240 | 1,500 | 92.4 | 3.6 | 3.9 |
| 4 | 1,000 | 260 | 1,400 | 90.9 | 6.6 | 2.4 |
| 5 | 1,000 | 260 | 1,300 | 89.0 | 7.1 | 3.8 |
| 6 | 1,000 | 220 | 1,400 | 90.8 | 2.1 | 7.0 |
| 7 | 1,000 | 220 | 1,300 | 89.5 | 2.6 | 7.8 |

COMPARATIVE EXAMPLE

Figure 2:
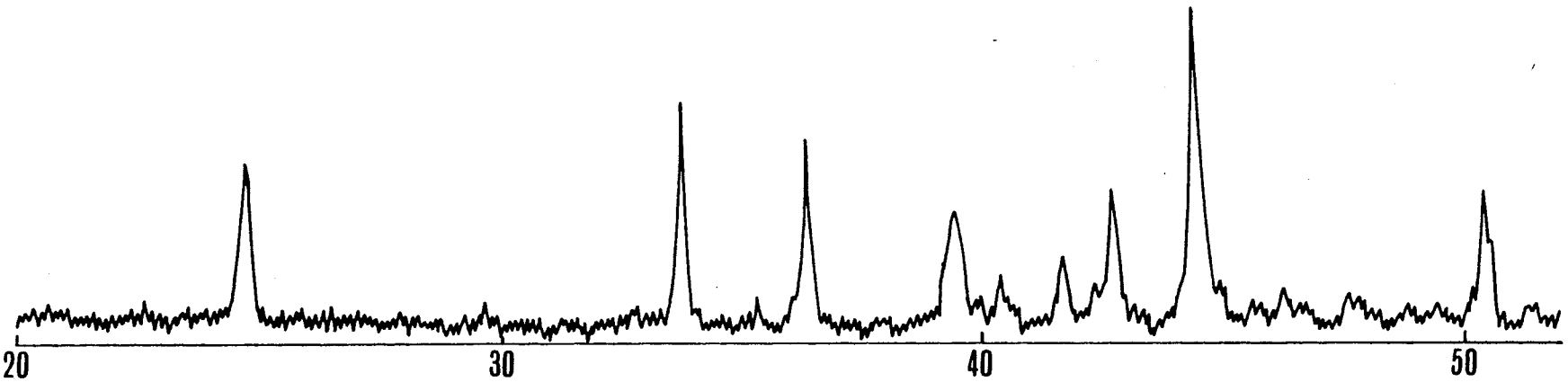
FIG. 2 shows an X ray diffraction pattern of a pellet of a powder mixture of chromium oxide, chromium carbide, and metallic chromium.

For comparison, pellets were prepared from a mixture of 15.98 g of powdery chromium oxide ($Cr_2O_3$), 43.44 g of powdery chromium carbide ($Cr_7C_3$), and 40.58 g of powdery metallic chromium. The X ray diffraction pattern of the pellets is shown in FIG. 2.

Atomic analysis of the resulting pellets gave the values of Cr: 90.4% by weight, C: 4.5% by weight, and O: 5.0% by weight. In the X ray diffraction pattern, no peak was observed at d=3.32 Å (2θ=26.8°).

EXAMPLE 8

Employing the additive of the present invention, a nickel-based alloy intended to have a composition equivalent to Inconel 600, as shown in Table 4, was prepared without adding the Mn, Si, and Cu components, according to the procedure described below.

TABLE 4

| | (% by weight) | | | | | | |
|---|---|---|---|---|---|---|---|
| | Ni | Cr | Fe | C | Mn | Si | Cu |
| (Weight %) | Balance | 15.5 | 8.0 | 0.08 | 0.5 | 0.2 | 0.2 |

Firstly, 36 kg of electrolytic nickel and 4 kg of electrolytic iron were charged into a spinel crucible placed in a 100-KW vacuum high-frequency induction furnace. Secondly, the chamber of the induction furnace was evacuated to a pressure $1\times10^{-3}$ Torr. Then heating was conducted at a frequency of 2 KHz, a voltage of 80 V and an electric power of about 20 KW for 30 minutes. The voltage was then raised to 250 V and heating was continued at a power of about 60 KW. Thirty minutes after the voltage was increased, when the nickel and the iron had completely melted into a molten metal, argon gas was introduced into the chamber at the pressure of 10 Torr. Thereafter, 8.6 kg of the chromium additive prepared in Example 1 was slowly added directly to the melt by use of a remote controlled hand. The chromium additive rapidly dissolved in the molten metal. Approximately 15 minutes after the addition of the chromium additive to the molten metal, argon gas was introduced into the chamber at a pressure of 250 Torr. Then in the chamber, the melt containing the additive was poured into a water-cooled copper crucible, thus preparing an ingot. The result of the atomic analysis of the ingot is shown in Table 5.

It can be understood from the Table 5 that the prepared ingot contains very little impurities, and achieves the intended quality.

TABLE 5

| | (% by weight) | | | | | | |
|---|---|---|---|---|---|---|---|
| Ni | Cr | Fe | C | P | N | S | O |
| Balance | 16 | 8 | 0.01 | 0.005 | 0.001 | 0.001 | 0.02 |

EXAMPLE 9

Employing the chromium additive of the present invention, a stainless steel, which corresponds to JIS 329J1 having a composition shown in Table 6, was prepared according to the procedure below.

TABLE 6

| (% by weight) Classification Symbol: SUS 329J1 | |
|---|---|
| C | not more than 0.08 |
| Si | not more than 1.00 |
| Mn | not more than 1.50 |
| P | not more than 0.040 |
| S | not more than 0.030 |
| Ni | from 3.00 to 6.00 |
| Cr | from 23.00 to 28.00 |
| Mo | from 1.00 to 3.00 |

Note: Other alloy elements may be added optionally.

An ingot was prepared in the same manner as in Example 8 except that 34 kg of electrolytic iron, 3 kg of electrolytic nickel, and 1 kg of molybdenum were used as the raw materials, and 13.8 kg of the additive prepared in Example 3 was used. The result of the atomic analysis of the prepared ingot is shown in Table 7.

It can be understood from Table 7 that the prepared ingot contains very little impurities, and provides a stainless steel having the intended quality.

TABLE 7

| | | | (% by weight) | | | | | |
|---|---|---|---|---|---|---|---|---|
| Ni | Cr | Fe | C | Mo | P | N | S | O |
| 6 | 25 | Balance | 0.05 | 2 | 0.005 | 0.001 | 0.001 | 0.02 |

EXAMPLE 10

A chromium additive was prepared in the same manner as described in Example 1 except that 1000 g of chromium oxide and 250 g of graphite were used, both being of the same quality as in Example 1, and reduction with heating was conducted at 1400° C. for 3 hours. The resulting additive had a composition as shown in Table 7. The X ray diffraction pattern had a peak at d=3.32 Å (2θ=26.8°).

Figure 3:
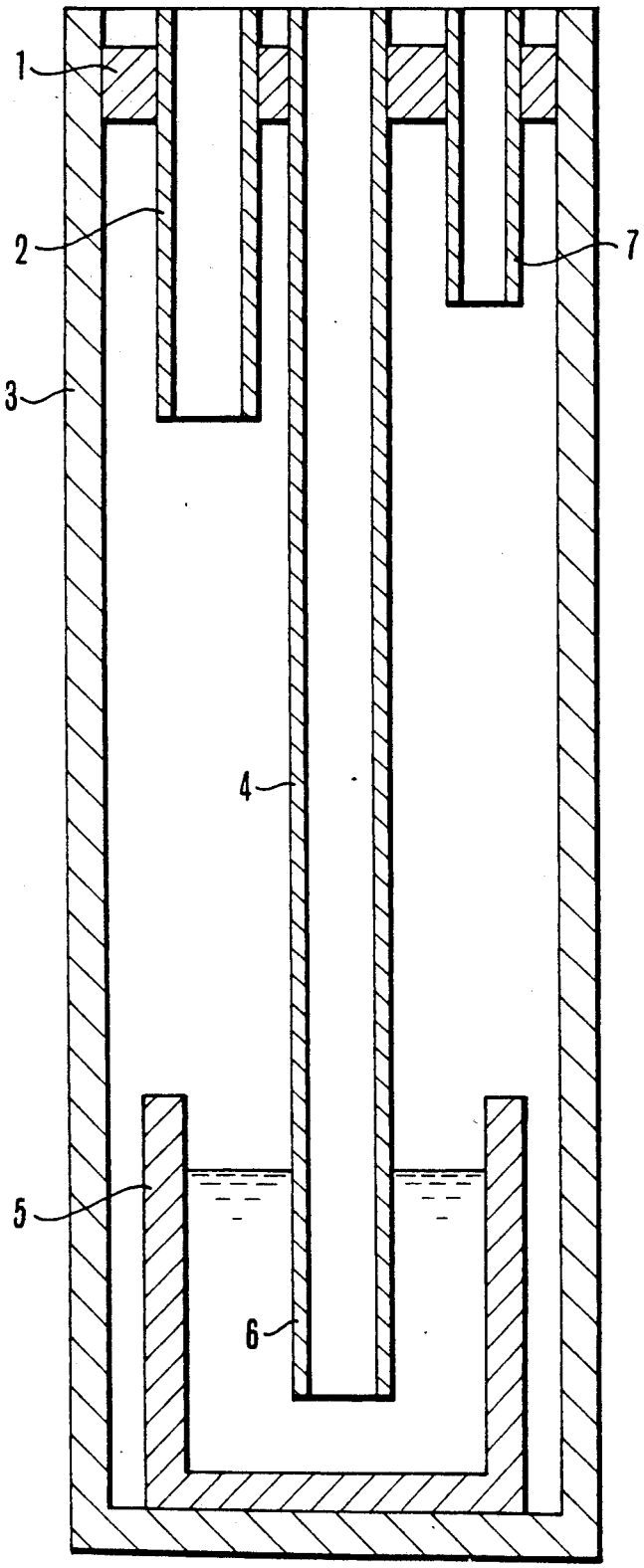
FIG. 3 is a schematic diagram of an apparatus for production of the chromium alloy of the present invention.

By employing the additive thus prepared and nickel of the quality shown in Table 8, two nickel alloys of 20% Cr-80% Ni and 40% Cr-60% Ni (percentages by weight) were prepared with the apparatus shown in FIG. 3.

TABLE 8

| | (% by weight) | | | | | | |
|---|---|---|---|---|---|---|---|
| Component | Cr | Ni | C | O | Fe | Al | Si |
| Additive | 95.0 | — | 2.40 | 2.30 | 0.23 | 0.007 | 0.008 |
| Nickel | — | 99.97 | 0.01 | — | 0.0015 | — | — |

FIG. 3 illustrates an apparatus preferably used in the method of preparation of the present invention.

In the preparation of the alloy, the additive and nickel were blended in amounts sufficient to achieve the intended alloy composition, and then the mixture was melted in a crucible 5 at 1500° C. to prepare a melt. (Incidentally the illustration of a heating device is omitted in FIG. 3). The quantities of materials blended were 320 g of nickel and 85 g of the additive for an alloy of 20% Cr-80% Ni (by weight), and 240 g of nickel and 170 g of the additive for an alloy of 40% Cr-60% Ni (by weight). The apparatus was sealed by a rubber stopper 1 in order to exclude external air from the interior of the apparatus. A nozzle 2 was provided approximately 10 cm above the surface of the melt, and a nozzle 4 was inserted into the melt. Through these nozzles argon gas was blown onto or into the melt. The flow rates of argon gas were 1.3 liter/minute for nozzle 2, and 0.3 liter/minute for nozzle 4. The argon gas had been dried by silica gel and magnesium perchlorate and deoxygenated by sodium metal chips maintained at 400° C. The partial pressure of oxygen in the deoxygenated argon was $2.6\times10^{-13}$ atm as measured by an oxygen sensor employing a zirconia solid electrolyte.

After completion of the melting, argon gas was introduced into the furnace for 60 minutes. During the argon introduction, the progress of removal of carbon and oxygen was observed by sampling. The results are illustrated in FIG. 4 and FIG. 5.

Figure 4:
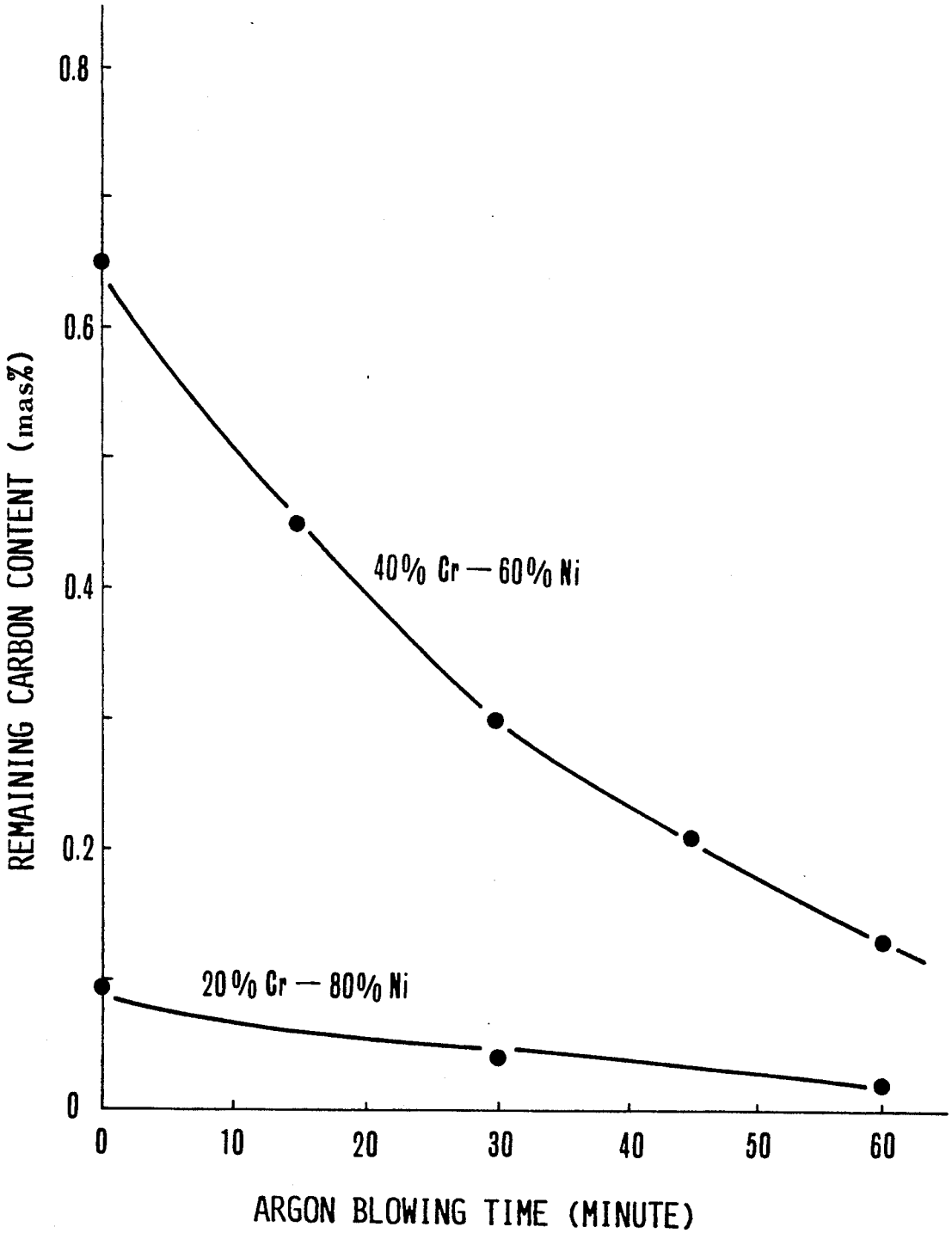
FIG. 4 illustrates changes of the residual carbon content in the alloys prepared in Example 10 as a function of time of argon gas introduction.
Figure 5:
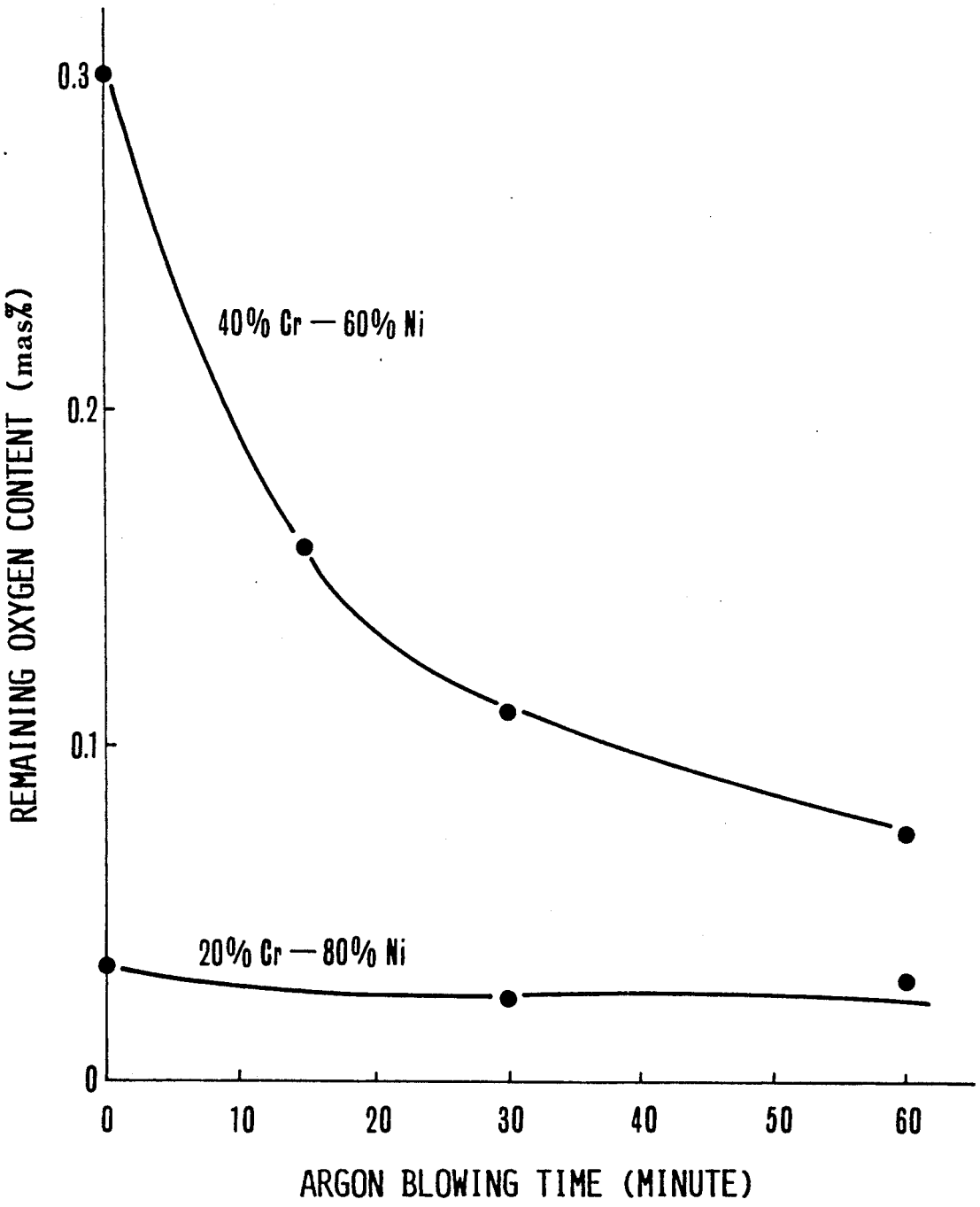
FIG. 5 illustrates changes of the residual oxygen content in the alloys prepared in Example 10 as a function of time of argon gas introduction.

From FIG. 4 and FIG. 5, a decrease of oxygen and carbon in the alloy as a function of elapsed time is observed, which is caused by blowing of argon gas onto and into the melt. The recovery of chromium in the alloy was approximately 100%, and a chrome-nickel alloy approximately equal to that intended was prepared.

As shown in FIG. 4, the reaction velocity follows apparently first order kinetics, so that the estimated formula (1) for retaining the required amount of carbon or oxygen was derived as below:

$$\ln(\%C)=0.026t-4.28+0.096(\%Cr) \quad (1)$$

where ln(%C) is the natural logarithm of the carbon concentration (% by weight) in the alloy, t is time in minutes, and (%Cr) is chromium concentration (% by weight) in the nickel alloy.

Obviously, numerous modifications and variations of the present invention are possible in light of the above teachings. It is therefore to be understood that within the scope of the appended claims, the invention may be practiced otherwise than as specifically described herein.

What is new and desired to be secured by Letters Patent of the United States is:

1. A chromium additive of the formula $Cr_xC_yO_z$, wherein $0.04\leqq y\leqq0.35$, and $0.03\leqq z\leqq0.30$ for x=1, said additive having an X ray diffraction peak at d=3.32 Å (2θ=26.8°).

2. A method of for producing a chromium additive of the formula: $Cr_xC_yO_z$, wherein $0.04\leqq y\leqq0.35$, and $0.03\leqq z\leqq0.30$ for x=1, said additive having an X-ray diffraction peak at d=3.32 Å (2θ=26.8°), comprising:

mixing and pelletizing chromium oxide and from 20 to 25% by weight of carbon, based on the weight of chromium oxide, and subsequently heating and reducing the pelletized material at a temperature of from 1200° C. to 1500° C. for a time from one hour to three hours.

3. The method of claim 2, wherein said carbon is carbon black, artificial graphite or petroleum coke.

4. The method of claim 2, wherein, prior to reduction, the pelletized material is dried at a temperature ranging from 100° to 200° C.

5. A method for producing a chromium alloy, comprising the steps of:

producing a melt by adding a chromium additive of the formula: $Cr_xC_yO_z$, wherein $0.04\leqq y\leqq0.35$, and $0.03\leqq z\leqq0.30$ for x=1, said additive having an X ray diffraction peak at d=3.32 Å (2θ=26.8°), to a molten metal; and blowing an inert gas onto the surface of the melt.

6. The method of claim 5, where the temperature of the molten metal is kept within a range of from 1300° C. to 1700° C.

7. A method for producing a chromium alloy, comprising the steps of:

producing a melt by adding a chromium additive of the formula: $Cr_xC_yO_z$, wherein $0.04\leqq y\leqq0.35$, and $0.03\leqq z\leqq0.30$ for x=1, said additive having an X ray diffraction peak at d=3.32 Å (2θ=26.8°), to a molten metal; and blowing an inert gas into the melt.

8. The method of claim 7, where the temperature of the molten metal is kept within a range of from 1300° C. to 1700° C.

* * * * *